US006541706B2

(12) United States Patent
McLeod

(10) Patent No.: US 6,541,706 B2
(45) Date of Patent: Apr. 1, 2003

(54) RESHEATHABLE CABLE ARMOR

(75) Inventor: Christopher R. McLeod, Jakhrta, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/778,507

(22) Filed: Feb. 7, 2001

(65) Prior Publication Data

US 2002/0104675 A1 Aug. 8, 2002

(51) Int. Cl.[7] ..... H01B 7/34
(52) U.S. Cl. ..... 174/102 R
(58) Field of Search ..... 174/102 R, 106 R, 174/105 R, 116, 113 R

(56) References Cited

U.S. PATENT DOCUMENTS 2,866,843 A * 12/1958 Arman ..... 174/106 R
4,041,237 A * 8/1977 Stine et al. ..... 174/10
5,410,106 A * 4/1995 Nishino et al. ..... 174/102 R
5,481,068 A * 1/1996 Norden ..... 174/10
6,127,632 A * 10/2000 Oswald et al. ..... 174/113 R

* cited by examiner

*Primary Examiner*—Chau N. Nguyen
(74) *Attorney, Agent, or Firm*—Fletcher, Yoder & Van Someren; Jeffrey E. Griffin; Brigitte Jeffery

(57) ABSTRACT

A system of resheathing armored power cables that provides multiple uses in harsh environments, such as those found in wellbore applications, before the integrity of the inner core of the cable is degraded. The resheathing system utilizes a sacrificial insulated jacket providing additional protection to the cable's inner core. The sacrificial jacket and the outer armor layer may be easily removed by the use off a rip cord or multiple rip cords. Removal of the sacrificial jacket and armor layer allow the inner core of the cable to be resheathed in the field for reuse.

10 Claims, 3 Drawing Sheets

RESHEATHABLE CABLE ARMOR

FIELD OF THE INVENTION

The present invention relates generally to a cable, such as a downhole electrical power cable, designed to protect the conductive inner core, to allow the easy removal of corroded or damaged armor, and to facilitate the cost effective replacement of the armor and reuse of the cable core.

BACKGROUND OF THE INVENTION

In a variety of applications, it is necessary to use an armored electrical power cable in a hostile environment. For example, in subsurface production of liquids, such as oil, it may be necessary to provide electrical power to an electric submersible pumping system located deep underground. Typically, a power cable is run downhole and connected to a submersible electric motor. The electric motor is powered to turn a centrifugal pump that intakes the production fluid and raises it or moves it to a desired location, such as the surface of the earth.

In such applications, the electric submersible pumping system often is utilized within a wellbore at a location deep beneath the surface of the earth. In that type of environment, components are subjected to extreme pressures and often to corrosive environments. Thus, it can be difficult to protect the vital inner components of the power cable core and to maintain the integrity of its outer layers.

In conventional downhole electrical power cables, there is an inner core of copper conductors encased in high dielectric insulation, a barrier layer, and a rubber jacket. A layer of armor typically composed of galvanized steel, stainless steel, or Monel protects this inner core. The downhole electrical power cable is reused until such time as the armor is corroded or damaged or until the cable conductors short out.

When the layer of armor is damaged the cable is either repaired in sections, scrapped or stripped down to recover the copper conductors. The bulk of galvanized armor scrapped in the field is due to corroded or rusted armor which usually causes varying degrees of surface damage to the jacket. While the damaged armor can be replaced in the field, the damaged surfaces of the rubber jacket often will not allow proper wrapping of the armor on the cable due to surface unevenness. If the cable is not repaired for reuse, the armor, jacket, and insulation are stripped away to recover the copper conductor which is resold to the cable manufacturer.

It would be advantageous to create a relatively simple cable which would allow repair and reuse of the cable on a routine basis.

SUMMARY OF THE INVENTION

The present invention features a resheathable cable armor system. The system includes a sacrificial insulation jacket over the current inner core. This sacrificial inner jacket is in addition to the current insulation system. Therefore it can be removed without compromising the original insulation capacity.

According to another aspect of the invention, the cable is designed with a rip cord or cords disposed longitudinally along its length. Pulling the ripcord or cords slits through the sacrificial jacket and armor layer without undermining the integrity of the inner core and allows the easy removal of the sacrificial jacket and armor layer. A field usable armor installation machine can then be used in the field to re-armor the used cable, allowing its reuse. This gives the cable a minimum of two uses in the field before it is scrapped or salvaged.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
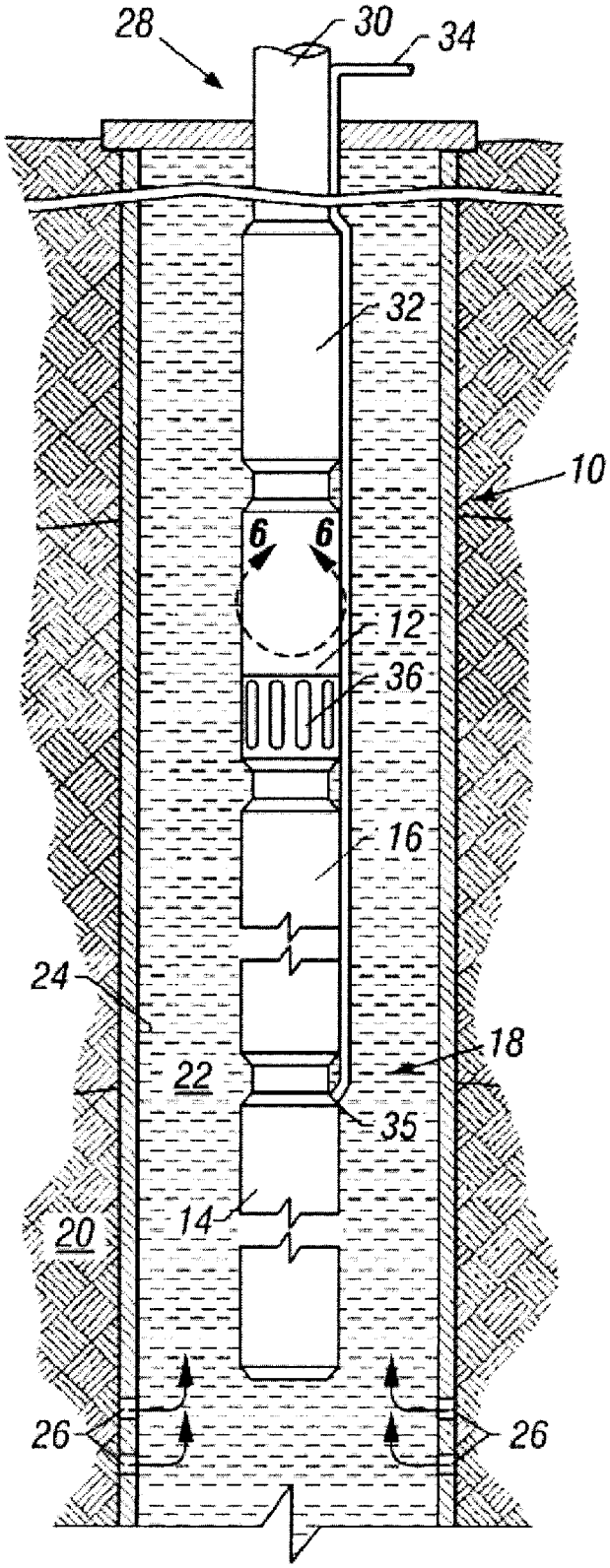
FIG. 1 is a front elevational view of a submersible pumping system disposed within a wellbore and powered via multiconductor power cable.

Referring generally to FIG. 1, an exemplary, high pressure environment is illustrated. In this particular application, an armored multiconductor power cable is coupled to a submersible pumping system in a downhole, wellbore environment by a connector. The pumping system may be an electric submersible pumping system 10. Typically, system 10 includes at least a submersible pump 12, such as a centrifugal pump, a submersible motor 14 and a motor protector 16.

In the illustrated example, pumping system 10 is designed for deployment in a well 18 within a geological formation 20 containing desirable production fluid, such as petroleum. In a typical application, a wellbore 22 is drilled and lined with a wellbore casing 24. Wellbore casing 24 may include a plurality of openings 26 through which production fluids flow into the wellbore 22.

Pumping system 10 is deployed in wellbore 22 by a deployment system 28 that may have a variety of forms and configurations. For example, deployment system 28 may comprise tubing 30 connected to pump 12 by a connector 32. Power is provided to submersible motor 14 via a power cable 34 coupled to a submersible component, e.g., motor 14, by a power cable connector or pothead 35. Motor 14, in turn, powers centrifugal pump 12 which draws production fluid in through a pump intake 36 and pumps the production fluid to the surface via tubing 30.

It should be noted that the illustrated submersible pumping system 10 is merely an exemplary embodiment. Other components can be added to the system, and other deployment systems may be implemented. Additionally, the production fluids may be pumped to the surface through tubing 30 or through the annulus formed between deployment system 28 and wellbore casing 24. Also, power cable 34 may be coupled to other submersible components.

Figure 2:
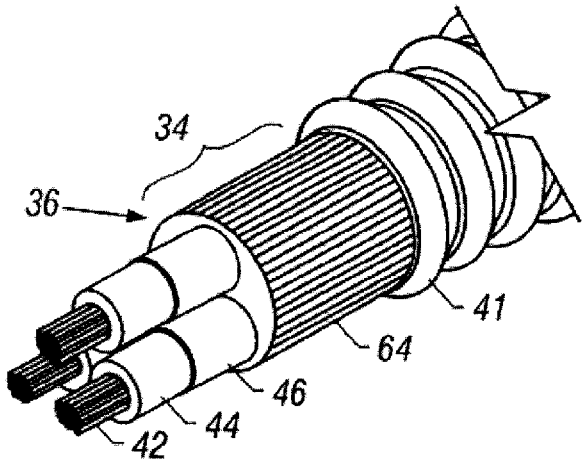
FIG. 2 is a perspective view of a typical armored multiconductor power cable of the type used within a wellbore.

As illustrated in FIG. 2, a typical power cable 34 includes three conductors 42 for carrying three phase power to a submersible component, such as motor 14. The three conductors 42 are each protected by a layer of insulation 44. Each insulation layer 44 is in turn protected by a barrier layer 46. These conductors 42 protected by their insulation 44 and barrier 46 layers are enclosed in a jacket 64. Together, this jacket 64 and the components it surrounds constitute the inner core 36 of the power cable. In the typical cable illustrated, this inner core is in turn protected by a layer of armor 41 to complete the typical multiconductor power cable 34.

Figure 3:
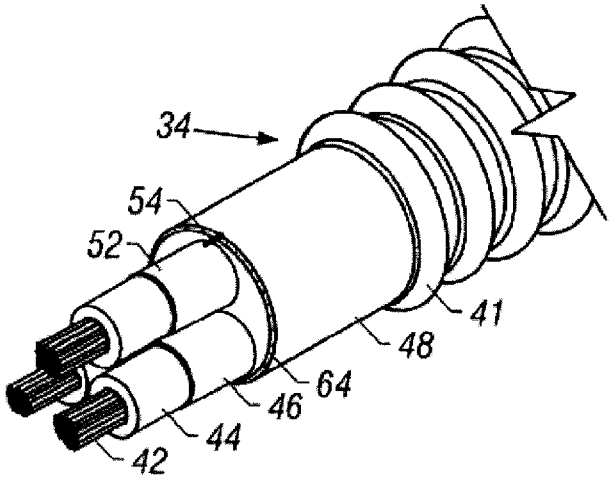
FIG. 3 is a perspective view of an armored multiconductor power cable containing a sacrificial jacket and rip cord, according to one embodiment of the present invention.

FIG. 3 illustrates a typical embodiment of the present invention. The components of the inner core, the conductors 42, the insulation 44, the barriers 46, and the jacket 64 are all present. In the embodiment illustrated, the inner core is in turn protected by a sacrificial jacket 48 over which the armor layer 41 is situated. In this example, the sacrificial jacket 48 contains or is disposed adjacent a fixture, such as a rip cord 54, which extends longitudinally along its length.

Figure 4:
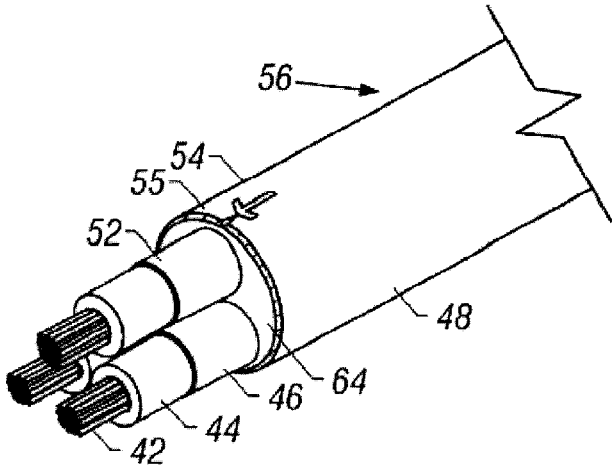
FIG. 4 is a perspective view of an unarmored multiconductor power cable having a sacrificial jacket removed via a rip cord, according to one embodiment of the present invention.

As further illustrated in FIG. 4, in one embodiment of the present invention, pulling the rip cord 54 produces a slit 55 in the sacrificial jacket 48 of an unarmored power cable 56. This slit 55 facilitates the removal of the sacrificial jacket 48. Rip cord 54 may have a variety of forms but should be strong enough to tear or cut through sacrificial jacket 48. For example, rip cord 54 may be a wire disposed longitudinally along the inner surface of sacrificial jacket 48. Rip cord 54 may also comprise a metallic or non-metallic cord having a knife edge, e.g. a pointed edge, to facilitate cutting through jacket 48.

Figure 5:
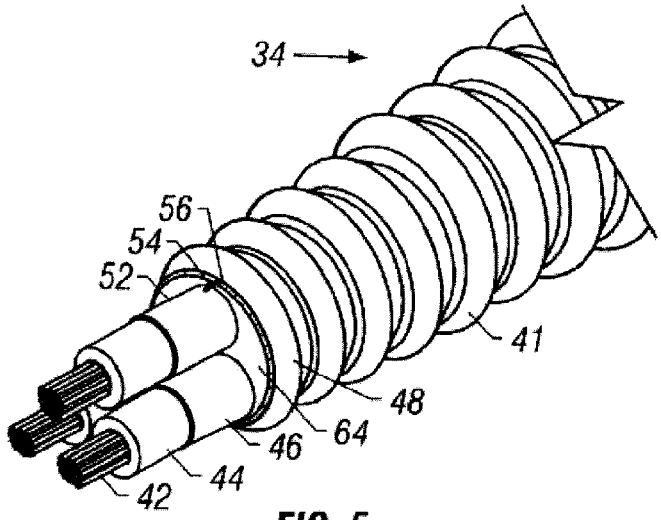
FIG. 5 is a perspective view of an armored multiconductor power cable containing a sacrificial jacket and rip cord, according to one embodiment of the present invention.

An alternate embodiment is illustrated in FIG. 5 where power cable 34 is protected by armor layer 41. Armor layer 41 is situated over a sacrificial jacket 48 containing a rip cord 54. In the embodiment illustrated, rip cord 54 is capable of being.pulled through both the sacrificial jacket 48 and armor layer 41, allowing the easy removal of both. In this case, the rip cord 54 often is formed of steel or other material sufficiently strong to cut through armor layer 41. Also rip cord 54 may be formed with a cutting edge 56, such as a knife edge, to facilitate cutting through armor layer 41.

Figure 6:
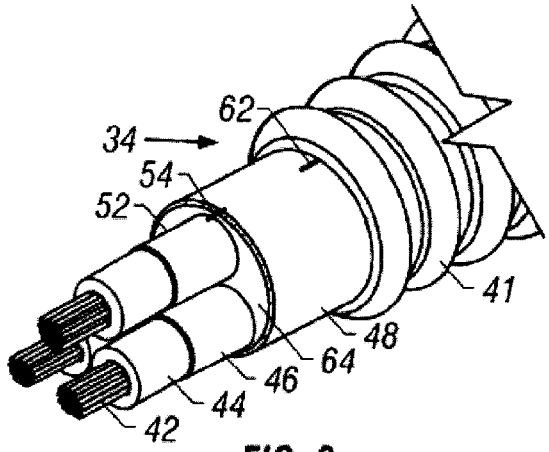
FIG. 6 is a perspective view of an armored multiconductor power cable containing a sacrificial jacket, rip cord, and an armor rip cord, according to one embodiment of the present invention.

An alternative embodiment is illustrated in FIG. 6 where armor layer 41 contains an armor rip cord 62 which extends longitudinally along its length. Armor rip cord 62 is capable of being pulled through armor layer 41, allowing its easy removal. Removal of armor layer 41 exposes the sacrificial jacket 48 and rip cord 54 which may be pulled to remove the sacrificial jacket 48.

Figure 7:
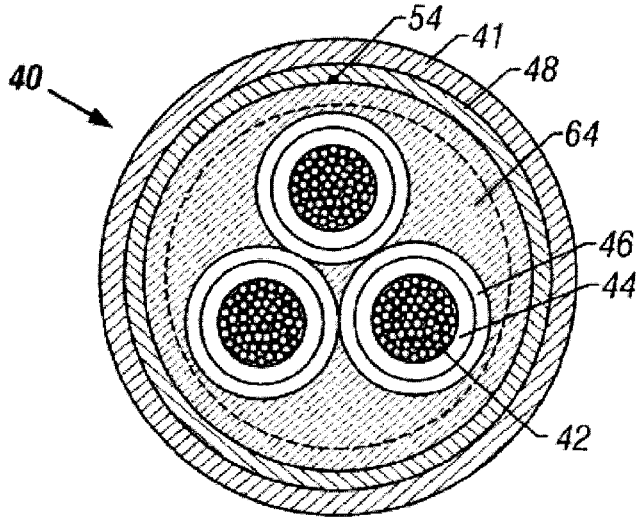
FIG. 7 is a cross-sectional view of an armored multiconductor power cable, according to one embodiment of the present invention.

FIG. 7 provides a cross sectional view of one embodiment of the present invention, where a rip cord 54 is embedded in the sacrificial jacket 48 beneath the armor layer 41. Pulling an external exposure of rip cord 54 tears through the sacrificial jacket 48 and the armor layer 41, allowing easy removal of the interior conductors 42 and their surrounding materials. The inner core of jacket 64, barriers 46, insulation 44, and conductors 42 is clear in cross-section.

The described embodiments provide a technique to recover an intact and undamaged inner core of a power cable which may then be rearmored in the field to produce the typical cable seen in FIG. 1. Alternatively, the recovered inner core can be resheathed in a new sacrificial jacket and then rearmored to produce a cable as embodied in this invention as seen in FIG. 5 or in FIG. 6. Another embodiment allows for a plurality of sacrificial jackets covering the inner core such that removal of the outer sacrificial jacket would reveal a fresh sacrificial jacket. The inner core sheathed in a fresh sacrificial jacket is then rearmored to produce a cable as embodied in this invention as illustrated in FIG. 5 or in FIG. 6.

It will be understood that the foregoing description is of preferred exemplary embodiments of this invention, and that the invention is not limited to the specific forms shown. For example, a variety of materials and housing configurations may be used according to the specific environments or applications. These and other modifications may be made in the design and arrangement of the elements without departing from the scope of the invention as expressed in the appended claims.

What is claimed is:

1. A power cable for use in a downhole environment, comprising:

a plurality of conductors;

a sacrificial jacket disposed about the plurality of conductors;

a rip cord disposed longitudinally along the sacrificial jacket; and an armor layer disposed about the sacrificial jacket, wherein the rip cord comprises a fixture having a knife edge.

2. The power cable as recited in claim 1, further comprising an armor rip cord disposed longitudinally along the armor layer.

3. The power cable as recited in claim 2, wherein the armor rip cord is high strength and corrosion resistant.

4. The power cable as recited in claim 1, wherein the rip cord is high strength and corrosion resistant.

5. The power cable as recited in claim 1, wherein the plurality of conductors comprise copper wire and an insulation system.

6. The power cable as recited in claim 1, wherein the armor layer comprises a galvanized steel material.

7. The power cable as recited in claim 1, wherein the armor layer comprises a stainless steel material.

8. The power cable as recited in claim 1, wherein the armor layer comprises a Monel material.

9. The power cable as recited in claim 1, wherein the sacrificial jacket is insulated.

10. A power cable for use in a downhole environment, comprising:

a plurality of insulated copper wire conductors;

a sacrificial insulated jacket disposed about the plurality of conductors;

a rip cord disposed longitudinally along the sacrificial jacket;

an armor layer disposed about the sacrificial jacket; and an armor rip cord disposed longitudinally along the armor layer and comprised of a fixture having a knife edge.

* * * * *